US006347212B1

(12) United States Patent
Kosugi et al.

(10) Patent No.: US 6,347,212 B1
(45) Date of Patent: Feb. 12, 2002

(54) IMAGE FORMING APPARATUS HAVING IMPROVED IMAGE CARRIER CLEANING

(75) Inventors: Hideki Kosugi; Sadayuki Iwai, both of Kanagawa; Katsuhiro Echigo, Saitama; Makoto Obu; Takashi Kawashima, both of Kanagawa, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/672,308

(22) Filed: Sep. 29, 2000

(30) Foreign Application Priority Data

Oct. 1, 1999 (JP) ..... 11-281113
Mar. 23, 2000 (JP) ..... 2000-082641
Sep. 1, 2000 (JP) ..... 2000-266341

(51) Int. Cl.[7] ..... G03G 21/00
(52) U.S. Cl. ..... 399/348; 399/343
(58) Field of Search ..... 399/368, 249, 399/343, 344, 350, 353, 354, 359, 302, 308; 430/117, 118, 119

(56) References Cited

U.S. PATENT DOCUMENTS 4,640,605 A 2/1987 Ariyama et al. ..... 399/225
4,720,731 A 1/1988 Suzuki et al. ..... 399/239
4,800,839 A 1/1989 Ariyama et al. ..... 399/57
4,801,965 A 1/1989 Mochizuki et al. ..... 399/29
4,833,500 A 5/1989 Mochizuki et al. ..... 399/55
5,021,834 A 6/1991 Tsuruoka et al.
5,155,534 A 10/1992 Kurotori et al.
5,164,778 A * 11/1992 Tanabe et al. ..... 399/93 X
RE34,437 E 11/1993 Ariyama et al. ..... 399/225
5,359,398 A * 10/1994 Echigo et al. ..... 399/348 X
5,642,188 A 6/1997 Mochizuki et al.
5,652,080 A 7/1997 Yoshino et al.
5,666,616 A 9/1997 Yoshino et al.
5,678,158 A * 10/1997 Kurotori et al. ..... 399/390
5,708,938 A 1/1998 Takeuchi et al.
5,923,930 A 7/1999 Tsukamoto et al.
5,937,247 A 8/1999 Takeuchi et al. ..... 399/237
5,953,559 A 9/1999 Obu
5,987,281 A 11/1999 Kurotori et al.
5,987,282 A 11/1999 Tsukamoto et al.
6,029,036 A * 2/2000 Itaya et al. ..... 399/239
6,038,421 A 3/2000 Yoshino et al. ..... 399/239
6,072,972 A 6/2000 Obu et al.
6,108,508 A 8/2000 Takeuchi et al.
6,115,576 A 9/2000 Nakano et al.
6,148,169 A 11/2000 Tsukamoto
6,154,624 A 11/2000 Sasaki et al. ..... 399/250

* cited by examiner

*Primary Examiner*—Sophia S. Chen
*Assistant Examiner*—Hoan Tran
(74) *Attorney, Agent, or Firm*—Oblon, Spivak, McClelland, Maier & Neustadt, P.C.

(57) ABSTRACT

An image forming apparatus allowing an image carrier included therein to be desirably cleaned is disclosed. A developing device uses a developing liquid consisting of a carrier liquid and toner dispersed therein. A toner image produced by the developing device is transferred to an intermediate image transfer belt. A cleaning roller cleans the surface of the intermediate image transfer belt after the transfer of the toner image to a paper sheet or similar recording medium. A liquid cleaning device feeds a cleaning liquid to the cleaning roller. The developing liquid may be replaced with a dry developer containing at least powdery toner.

131 Claims, 6 Drawing Sheets

IMAGE FORMING APPARATUS HAVING IMPROVED IMAGE CARRIER CLEANING

BACKGROUND OF THE INVENTION

The present invention relates to a copier, facsimile apparatus, printer or similar image forming apparatus.

An image forming apparatus includes a developing unit using either a developing liquid, which consists of a carrier liquid and toner dispersed therein, or a dry powdery developer containing at least toner. Japanese Patent Laid-Open Publication Nos. 7-209922, 7-152254 and 7-239615. For example, each teach a developing unit using a dense, viscous developing liquid that consists of an insulative liquid and toner densely dispersed therein. This kind of developing liquid is directed toward the size reduction of the developing unit.

The above-mentioned Laid-Open Publication No. 7-209922, in particular, discloses a developing unit of the type developing a latent image formed on an image carrier with a developing liquid containing charged toner particles. The developing unit has a high toner content and viscosity as high as 100 mPa.s to 10,000 mPa.s. Developing means feeds the developing liquid to the surface of the image carrier via a conductive developer carrier.

It is a common practice with an image forming apparatus using a developing liquid to remove, with a cleaning device, the liquid remaining on a photoconductive element or image carrier or an intermediate image transfer body after image transfer. The intermediate image transfer body is another image carrier to which a toner image is transferred from the photoconductive element. The toner image is transferred from the intermediate image transfer body to a paper sheet or similar recording medium. Typical of the cleaning device is a cleaning blade formed of, e.g., urethane rubber or similar elastic material. The cleaning blade cleans the surface of the image carrier with its edge contacting the image carrier. A cleaning roller formed of, e.g. an elastic foam material is also known in the art. The cleaning roller is located upstream of the cleaning blade in the direction of rotation of the image carrier in such a manner as to rub the surface of the image carrier, thereby scraping off the toner of the residual developing liquid. At the same time, the cleaning roller absorbs the toner and carrier liquid. The cleaning blade scrapes off the developing liquid that the cleaning roller failed to remove.

However, even the above-described two cleaning devices sometimes fail to fully remove the residual developing liquid, resulting in defective cleaning. Specifically, when use is made of the dense, viscous developing liquid, the residual liquid remaining on the image carrier after image transfer scarcely contains the carrier liquid and causes the toner to cohere and adhere to the image carrier. In this condition, the cleaning device implemented by the cleaning blade cannot fully scrape off the cohered toner alone. The cleaning roller, even when combined with the cleaning blade, cannot fully scrape off the cohered toner due to its soft surface. This is particularly true when the image carrier is implemented by the intermediate image transfer body. This is because the solid content of the developing liquid increases every time a toner image transferred from the image carrier to the intermediate image transfer body and then to a paper sheet, aggravating the cohesion of the toner on the transfer body.

While the problem discussed above is apt to arise particularly in an image forming apparatus using a dense, viscous developing liquid, it is likely to arise in any image forming apparatus so long as it uses a developing liquid.

To remove toner entered pits existing in the surface of the image carrier, the cleaning blade has customarily been pressed against the image carrier by a high pressure (or by a great amount of bite when the image carrier is a belt) Such a pressure or an amount of bite, however, is apt to increase the drive load of the image carrier, affecting the drive of the image carrier while bringing about noise and the deformation of the cleaning blade. In addition, the above pressure or the amount of bite causes the wear and damage of the cleaning blade itself. For this reason, the pressure or the amount of bite of the cleaning blade is limited, so that the cleaning effect available with the blade scheme is limited. This is also true with an image forming apparatus using a dry powdery developer, which will be described later.

Japanese Patent Laid-Open Publication No. 9-230771 proposes an image forming apparatus including developing means using a developing liquid and cleaning means assigned to a photoconductive element or image carrier. The cleaning means is implemented by a cleaning blade, a foam roller located downstream of the blade in the direction of rotation of the photoconductive element, and liquid feeding means for feeding a cleaning liquid to the foam roller. The cleaning liquid is fed to the photoconductive element via the foam roller in order to remove the developing liquid left on the drum in such a manner as to wash it away. Further, the cleaning liquid wets toner cohered on the photoconductive element and thereby helps the foam roller and cleaning blade remove the toner. In addition, the cleaning liquid washes away toner entered the pits of the photoconductive element and causes toner to rise above the pits, facilitating the removal of the toner. In this manner, the cleaning means cleans the photoconductive element with an improved ability.

The above-described cleaning means using a cleaning liquid cleans a photoconductive element or image carrier with an improved ability. The above document, however, does not give any consideration to the defective cleaning of an intermediate image transfer body.

In an image forming apparatus using a dry powdery developer, a cleaning device removes toner left on an image carrier, which is a photoconductive element or an intermediate image transfer body, after image transfer. The cleaning device is implemented by a cleaning blade similar to the cleaning blade of the image forming apparatus using a cleaning liquid. The cleaning blade may be combined with a rotatable bias roller located downstream of the cleaning blade in the direction of rotation of the image carrier and facing the image carrier. This kind of cleaning device is taught in, e.g., Japanese Patent Laid-Open Publication No. 11-38777. In the cleaning device using both of the cleaning blade and bias roller, a voltage of preselected polarity is applied to the bias roller in order to form an electric field between the image carrier and the bias roller. The electric field causes toner charged to the opposite polarity to the above voltage to move toward the bias roller. Consequently, the toner, which the cleaning blade failed to remove, moves toward the cleaning member away from the image carrier on the basis of electrophoresis.

However, the current trend in the imaging art is toward toner having a smaller particle size and a more spherical shape. The probability that such toner contacts the cleaning member is low and apt to lower the cleaning ability. In these circumstances, there is an increasing demand for a higher cleaning ability even with an image forming apparatus of the type using a dry powdery developer.

SUMMARY OF THE INVENTION

It is therefore an object of the present invention to provide an image forming apparatus capable of cleaning an image carrier with an unprecedented ability.

In accordance with the present invention, an image forming apparatus includes a developing device using a developing liquid consisting of a carrier liquid and toner dispersed in the carrier liquid. An image carrier carries a toner image developed by the developing device. A cleaning verb r cleans the surface of the image carrier after the toner image has been transferred from the image carrier to a recording medium. A liquid feeding device feeds a cleaning liquid to the cleaning member The image carrier is implemented as an intermediate image transfer body for carrying the toner image transferred thereto from another image carrier. The toner image is transferred from the intermediate image transfer body to the recording medium.

Also, in accordance with the present invention, an image forming apparatus includes a developing device using a developing liquid consisting of a carrier liquid and toner dispersed in the carrier liquid. An image carrier carries a toner image developed by the developing device. A cleaning member cleans the surface of the image carrier after the toner image has been transferred from the image carrier to a recording medium. A liquid feeding device feeds a cleaning liquid to the surface of the image carrier after the surface has moved away from an image transfer position, but before it reaches the cleaning member. The image carrier is implemented as an intermediate image transfer body for carrying the toner image transferred thereto from another image carrier. The toner image is transferred from the intermediate image transfer body to the recording medium.

Further, in accordance with the present invention, an image forming apparatus includes a developing device using a powdery developer containing at least toner. An image carrier carries a toner image developed by the developing device. A cleaning member cleans the surface of the image carrier after the toner image has been transferred from the image carrier to a recording medium. A liquid feeding device feeds a cleaning liquid to the cleaning member.

Moreover, in accordance with the present invention, an image forming apparatus includes a developing device using a powdery developer containing at least toner. An image carrier carries a toner image developed by the developing device. A cleaning member cleans the surface of the image carrier after the toner image has been transferred from the image carrier to a recording medium. A liquid feeding device feeds a cleaning liquid to the surface of the image carrier after the surface has moved away from an image transfer position, but before it reaches the cleaning means.

In addition, in accordance with the present invention, an image forming apparatus includes a developing device using a developing liquid consisting of a carrier liquid and toner dispersed in the carrier liquid. An image carrier carries a toner image developed by the developing device. A cleaning member cleans the surface of the image carrier after the toner image has been transferred from the image carrier to a recording medium. An electric field forming device forms an electric field, which causes the toner of the residual developing liquid remaining on the image carrier to move toward the surface of the cleaning member, between the image carrier and the cleaning member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus in accordance with the present invention will be described hereinafter.

First Embodiment

Figure 1:
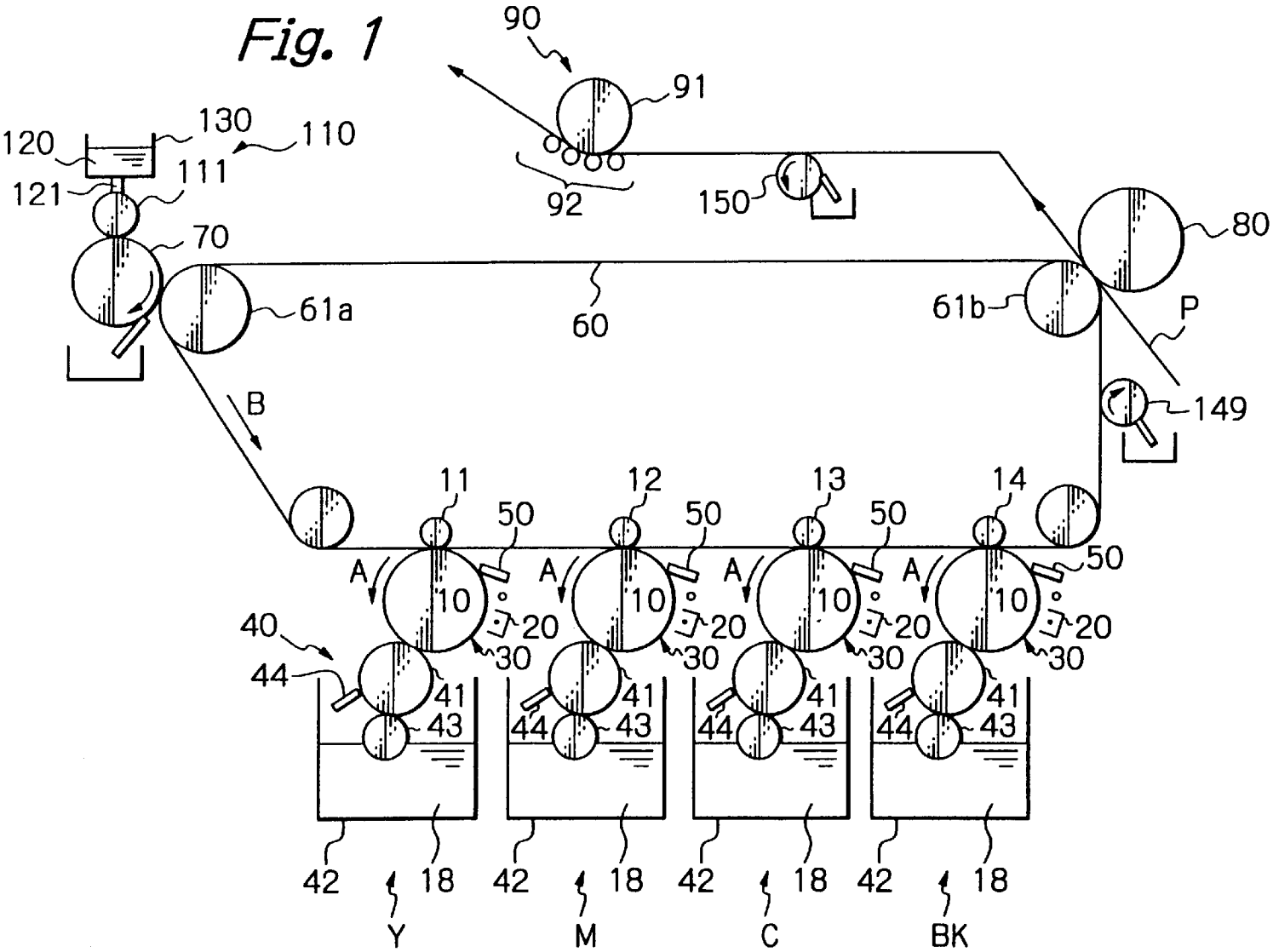
FIG. 1 is a view showing a first embodiment of the image forming apparatus in accordance with the present invention.

Referring to FIG. 1 of the drawings, an image forming apparatus embodying the present invention is shown and implemented as a color electrophotographic copier by way of example. As shown, the copier includes image forming units Bk (black), C (cyan), U (magenta) and Y (yellow) for forming a color image with a color image forming process. The image forming units Bk, C, N and Y each include a photoconductive drum or image carrier 10, an exposing device, a charger, a cleaning device, a discharge lamp, a developing device storing a developer of particular color. i.e., toner of particular color dispersed in a carrier liquid, and so forth. The image forming units Bk, C, N and Y each form a toner image of particular color on the drum 10. The drum 10 of each image forming unit is partly exposed to the outside via an opening formed in the casing of the unit and is rotatable in a direction indicated by an arrow A in FIG. 1.

A charger 20, an exposing device represented by a laser beam 30, a cleaning blade or cleaning means 50 and a developing unit 40 are arranged around the drum 10 of each image forming unit.

An intermediate image transfer belt (simply belt hereinafter) 60 is passed over a plurality of rollers and rotatable in contact with the drums 10 in a direction indicated by an arrow B in FIG. 1. The belt 60, which is another image carrier, is an elastic belt formed of carbon-dispersed conductive rubber. The surface of the belt 60 is coated with fluoric resin in order to improve smoothness. Toner images formed on the drum 10 are sequentially transferred to the belt 60 one above the other.

A cleaning roller or cleaning member 70 faces part of the belt 60 passed over a roller 61*a* in order to clean the surface of the belt 60. Conductive rollers 11, 12, 13 and 14 respectively face the drums 10 of the image forming units Y, M, C and Bk with the intermediary of the belt 60. A primary bias for image transfer is applied to each of the conductive rollers 11 through 14 for transferring 8 toner image from the drum 10 to the belt 60 (primary image transfer).

An image transfer roller 80 faces part of the belt 60 passed over another roller 61*b*. The image transfer roller 80 is a conductive roller to which a secondary bias for image transfer is applied for transferring a toner image from the belt 60 to a paper sheet or similar recording medium P (secondary image transfer). A squeeze roller 149 faces part of the belt 60 upstream of the position where the image transfer roller B0 faces the belt 60 in the direction B. The squeeze roller 149 removes excess part of the carrier liquid before the secondary image transfer, as will be described specifically later. The squeeze roller 149 does not contact the belt 60 so as not to disturb a toner image carried on the belt 60.

The image forming units Y through Bk include respective developing devices 40 substantially identical in configuration with each other. Each developing device 40 includes a tank 42 storing a developing liquid 18 that consists of a carrier liquid and toner of particular color densely dispersed in the carrier liquid. The developing liquid has viscosity as high as 100 mPa.s to 1,000 mPa.s. A developing roller or developer carrier 41 contacts the surface of the drum 10. An applicator roller 43 has its lower portion immersed in the developing liquid 18 and applies the liquid to the developing roller 41. A peeler blade 44 removes the developing liquid left on the developing roller 41 after development. In the illustrative embodiment, the carrier liquid is implemented by silicone oil.

The operation of the image forming apparatus will be described hereinafter. Because the image forming units Y through Bk form images with an identical principle, let the following description concentrate on the operation of the image forming unit Y by way of example. While the drum 10 is rotated in the direction A, the charger 20 uniformly charges the surface of the drum 10. The exposing device, not shown, scans the charged surface of the drum 10 with the laser beam 30 modulated in accordance with yellow image data, thereby forming a latent image on the drum 10. The developing device 40 develops the latent image with the yellow developing liquid is to thereby produce a yellow toner image. The operation of the developing device 40 will be described more specifically later.

The roller 11 applied with the primary bias transfers the yellow toner image from the drum 10 to the belt 60, which is rotating in the direction B in synchronism with the drum 10. After the primary image transfer, the cleaning blade 50 cleans the surface of the drum 10 so as to prepare it for the next image formation.

The above-described procedure is sequentially repeated with yellow, magenta, cyan and black in this order. The resulting yellow, magenta, cyan and black toner images are sequentially transferred from the drums 10 to the belt 60 one above the other. Asia result, a full-color image is completed on the belt 60. The image, transfer roller 80 applied with the secondary bias transfers the full-color image from the belt 60 to the paper sheet P fed from a paper feeder not shown. After the secondary image transfer, the paper sheet P is separated from the belt 80. Subsequently, a squeeze roller 150 removes excess part of the carrier liquid from the paper sheet P. Thereafter, a fixing unit 90 fixes the full-color image on the paper sheet P with a heat roller 91 and a plurality of press rollers 92. The paper sheet P with the fixed full-color image is driven out of the copier body.

In each developing device 40, the applicator roller 43 in rotation scoops up the developing liquid 18 and applies it to the developing roller 41. The developing liquid 18 forms a thin layer or film having preselected thickness on the developing roller 41. The developing roller 41 in rotation conveys the thin liquid layer to a developing position where the roller 41 contacts the drum 10. At the developing position, the thin liquid layer is peeled off from the developing roller 41 by a bias for development and transferred to the portion of the drum 10 where the latent image exists. The peeler blade 44 removes the developing liquid 18 left on the developing roller 41 after the development, causing the liquid 18 to drop into the tank 42 due to gravity.

How the belt 60 is cleaned, which is the characteristic part of the illustrative embodiment, will be described hereinafter. In the illustrative embodiment, a cleaning liquid is fed to the cleaning roller 70 in order to remove the developing liquid remaining on the belt 60 after the secondary transfer of the color image from the belt 60 to the paper sheet P. Specifically, a liquid feeding device or liquid feeding means 110 stores a cleaning liquid 120 implemented by silicone oil, which is also contained in the carrier liquid of the developing liquid 18.

The liquid feeding device 110 includes a tank 130 storing the cleaning liquid 120. A feed roller or liquid feeding member 111 feeds the cleaning liquid 120 to the cleaning roller 70. The feed roller 111 may be implemented by a roller formed of a hydrophilic porous material, sponge or similar liquid-holding material or a roller formed of rubber or similar elastic material or metal or similar rigid material. In the illustrative embodiment, use is made of a metallic roller.

In the illustrative embodiment, the cleaning liquid 120 is caused to drop from the tank 130 to the feed roller 111 via a nozzle 121. Alternatively, the feed roller 111 may be partly immersed in the cleaning liquid 120 in the tank 130 and rotated to convey the liquid 120 to the cleaning roller 70, in which case the liquid feeding member may be implemented by a brush roller.

The feed roller 111 carrying the cleaning liquid 120 thereon is rotated in contact with the cleaning roller 70 to thereby feed the liquid 120 to the roller 70. The feed roller 111 may be rotated in either one of forward and reverse directions with respect to the rotation of the cleaning roller 70. The cleaning roller 70 is rotated in contact with the belt 60 in a direction indicated by an arrow in FIG. 1, applying the cleaning liquid 120 to the belt 60. The cleaning liquid 120 removes the residual developing liquid remaining on the belt 60 in such a manner as to wash it away. At the same time, cleaning liquid 120 wets the toner cohered on the belt 60, helping the cleaning roller 70 remove the toner. Further, the cleaning liquid 120 washes away the toner entered pits existing on the surface of the belt 60 or causes such toner to rise above the pits for helping the cleaning roller 70 remove it.

The cleaning roller 70 should preferably be rotated at a speed h higher than the speed at which the surface of the belt 60 moves. This is successful to increase the shearing force to act on the toner present on the belt 60 and therefore to enhance the cleaning ability. In addition, the intense shearing force allows the cleaning liquid 120 to form a film as thin as 10 $\mu$m or less on the belt 60.

As stated above, the illustrative embodiment is capable of desirably removing cohered toner and toner entered the pits of the surface of the belt 60 despite that the developing liquid 18 has high density and high viscosity. The illustrative embodiment enhances the cleaning ability more than conventional image forming apparatuses of the type described.

The cleaning roller 70, playing the role of a cleaning member, may be replaced with a blade or a belt, if desired. As for a blade, the cleaning liquid 120 serves as a lubricant for reducing the drive load of the belt 60 and the wear of the blade itself. Therefore, even when pressure pressing the blade against the belt 80 or the amount of bite of the blade into the belt 60 is increased in order to enhance the cleaning ability, it does not effect the drive of the belt 60 or bring about noise or the deformation of the blade.

The cleaning liquid 120 may be directly fed from the liquid feeding member 111 to the belt 80 without the intermediary of the cleaning roller 70. In such an alternative arrangement, the cleaning liquid 120 will be fed to the surface of the belt 60 at a position between the image transfer roller 80 and the cleaning roller 70.

The feed roller 111, playing the role of a liquid feeding member, may be replaced with a piece of felt or similar liquid feeding material, in which case the cleaning liquid 120 will be fed from the tank 130 to the cleaning roller 70 by, e.g., capillarity. Further, use may be made of a liquid feeding member in the form of a roller having a porous surface layer and a base filled with the cleaning liquid 120. In this case, the cleaning liquid 120 will ooze out via the pores of the roller during the rotation of the roller so as to be fed to the belt 60.

Silicone oil used as the cleaning liquid 120 and also contained in the carrier liquid is desirable in that it allows the carrier liquid collected within the copier or a recycled carrier liquid prepared beforehand to be used, thereby reducing the supply cost ascribable to the cleaning liquid 120. For example, the carrier liquid removed by the squeeze roller 149 or 150 may be conveyed to the tank 130 via. e.g., a piping and reused.

First Modification

So long as the amount of the cleaning liquid 120 parried on the belt 60 is adequate, it does not effect a toner image to be transferred to the belt 60 later. However, the cleaning liquid 120 will disturb the toner image if carried on the belt 60 in an excessive amount. In light of this, a first modification of the first embodiment additionally includes regulating means for regulating the amount of the cleaning liquid 120 to deposit on the belt 60.

Figure 2:
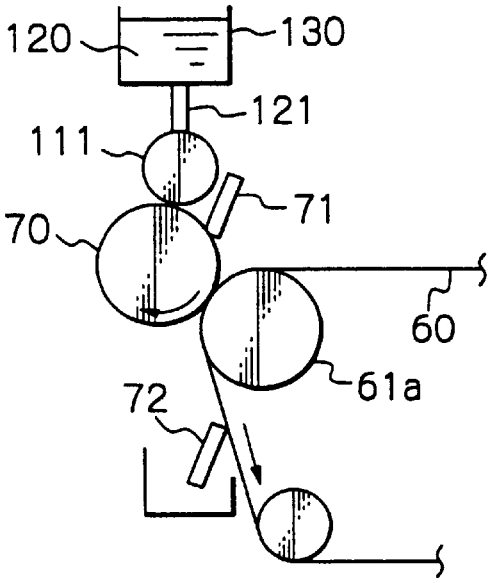
FIG. 2 is a fragmentary view showing a first modification.

As shown in FIG. 2, the first modification includes two blades 71 and 72 as the above-mentioned regulating means. The blade 71 regulates the amount of the cleaning liquid 120 to be conveyed by the cleaning roller 70 to the belt 60. The blade 72 regulates the amount of the cleaning liquid 120 deposited on the belt 60 at a position downstream of the cleaning roller 70 in the direction of movement of the belt 60. First, the blade 71 controls the amount of the cleaning liquid 120 deposited on the cleaning roller 70 such that the liquid 120 forms a film as thin as, e.g., 2 $\mu$m to 3 $\mu$m or less on the belt 60. Subsequently, the blade 72 further controls the amount of the cleaning liquid 120 deposited on the belt 60 such that the film thickness further decreases to. e.g., 1 $\mu$m or less.

As stated above, the first modification prevents the cleaning liquid 120 from depositing on the belt 60 in an excessive amount that would disturb a toner image to be formed on the belt 60 later. Moreover, the blade 72 removes the toner, which the cleaning roller 70 failed to remove, from the belt 60 together with the cleaning liquid 120, further enhancing the cleaning ability.

Either one of the two blades 71 and 72 may be omitted, if desired. Assume that the cleaning roller 70 has a surface formed of metal, hard rubber or similar material that provides the surface with high hardness and high smoothness. Then, it is desirable to control the amount of the cleaning liquid 120 deposited on the clearing roller 70. On the other hand, when the surface is formed of, e.g., a foam material, the amount of the cleaning liquid 120 deposited on the belt 60 should preferably be control led because it is difficult to control the liquid 60 deposited on such a cleaning roller 70.

Second Modification

Figure 3:
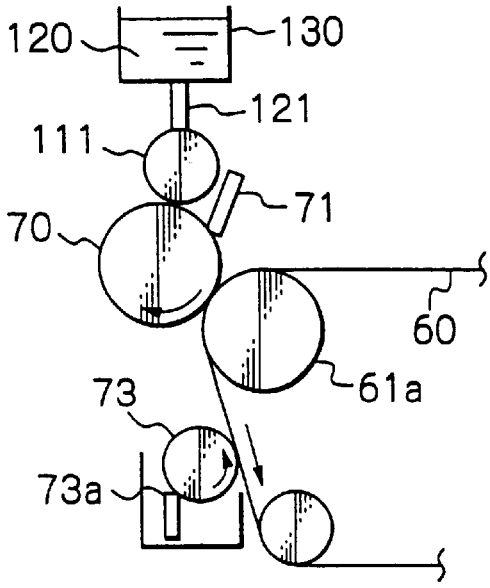
FIG. 3 is a fragmentary view showing a second modification.

FIG. 3 shows a second modification of the first embodiment. As shown, the second modification uses a roller 73 has a regulating member in place of the blade 72. The roller 73 has a surface formed of metal, hard rubber or similar material that provides the surface with high hardness and high smoothness. The roller 73 rotates in the opposite direction to the belt 60, as seen at the position where the former contacts the latter. The roller 73 in rotation exerts a shearing force on the belt 60 to thereby control the amount of the cleaning liquid 120 deposited on the belt 60, i.e., remove excessive part of the liquid 120. As a result, the cleaning liquid 120 forms a film as thin as, e.g. 1 $\mu$m or less on the belt 60 when moved away from the roller 73. A blade 73*a* scrapes off the cleaning liquid 120 collected by the roller 73.

As stated above, the second modification, like the first modification, prevents the cleaning liquid 120 from depositing on the belt 80 in an excessive amount that would disturb a toner image to be formed on the belt 60 later. Moreover, the roller 73 removes the toner, which the cleaning roller 70 failed to remove, from the belt 80 together with the cleaning liquid 120, further enhancing the cleaning ability.

Third Modification

Figure 4:
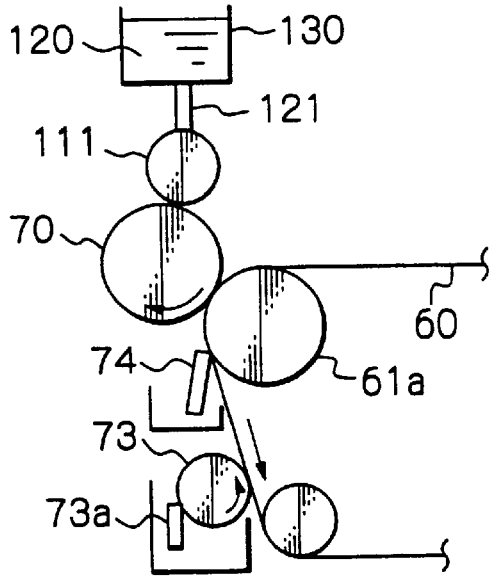
FIG. 4 is a fragmentary view showing a third modification.

A third modification of the first embodiment will be described with reference to FIG. 4. As shown, the third modification includes a second blade or regulating member 74 in addition to the arrangements shown in FIG. 3. The blade 74 is positioned upstream of the roller 73 in the direction of movement of the belt 60 for controlling the amount of the cleaning liquid 120 deposited on the belt 60. If desired, the blade 74 may be positioned downstream of the roller 74 in the above direction. With this configuration, the third modification promotes more strict control over the amount of the cleaning unit 120 and further enhances the cleaning ability.

The cleaning liquid 120 should preferably be implemented by volatile silicone oil having a mean molecular weight of $10^3$ or below. Such silicone oil causes the cleaning liquid 120 to volatilize and therefore obviates the need for the regulating means of the first to third modifications or reduces the ability required of the regulating means. This successfully reduces the cost and space requirements.

Second Embodiment

Figure 5:
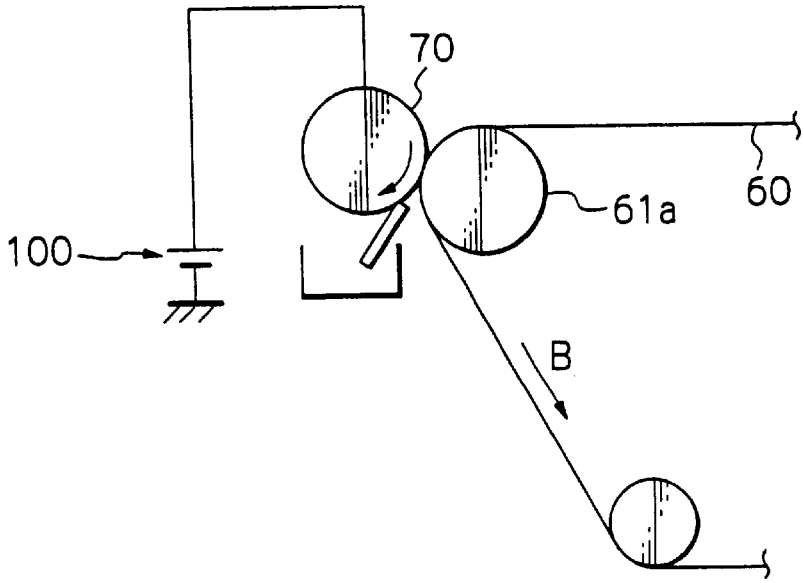
FIG. 5 is a fragmentary view showing a second embodiment of the present invention.

Reference will be made to FIG. 5 for describing an alternative embodiment of the present invention that is also implemented as a copier using a developing liquid. Briefly, the illustrative embodiment cleans the belt 60 by forming an electric field, which causes the toner contained in the residual developing liquid to move toward the cleaning roller 70, between the belt 60 and the roller 70. As shown, the copier includes a bias power source or voltage applying means 100 for applying a voltage to the cleaning roller 70. The cleaning roller 70 is formed of metal or similar conductive material.

The voltage applied from the bias power source 100 to the cleaning roller 70 is opposite in polarity to the chargeability of the toner contained in the developing liquid. For example, when the toner is chargeable to positive polarity, the bias power source 100 applies a negative voltage to the cleaning roller 70. As a result, an electric field that causes the toner to electrostatically move from the belt 60 toward the cleaning roller 70 is formed between the belt 60 and the roller 70. This is also successful to desirably remove toner cohered on the belt 60 and toner entered the pits of the belt 60. It was experimentally found that a bias voltage of −500 V to −2,000 V applied to the cleaning roller 70 insured desirable cleaning.

In the illustrative embodiment a negative bias voltage opposite in polarity to the chargeability of the toner is applied to the cleaning roller 70. Alternatively, when the toner is chargeable to positive polarity, a bias voltage of the same polarity as the toner, e.g., 2,000 V may be applied to the belt 60 with or without a bias voltage of the same polarity as the toner, e.g., 500 V being applied to the cleaning roller 70. Such a voltage can also form the expected electric field between the belt 80 and the cleaning roller 70.

As stated above, the illustrative embodiment is also capable of desirably removing cohered toner and toner entered the fits of the surface of the belt 60 despite that the developing liquid has high density and high viscosity. The illustrative embodiment enhances the cleaning ability more than conventional image forming apparatuses of the type described.

The conductive roller, playing the role of a cleaning member, may be replaced with a blade or a conductive belt, if desired.

Fourth Modification

Figure 6:
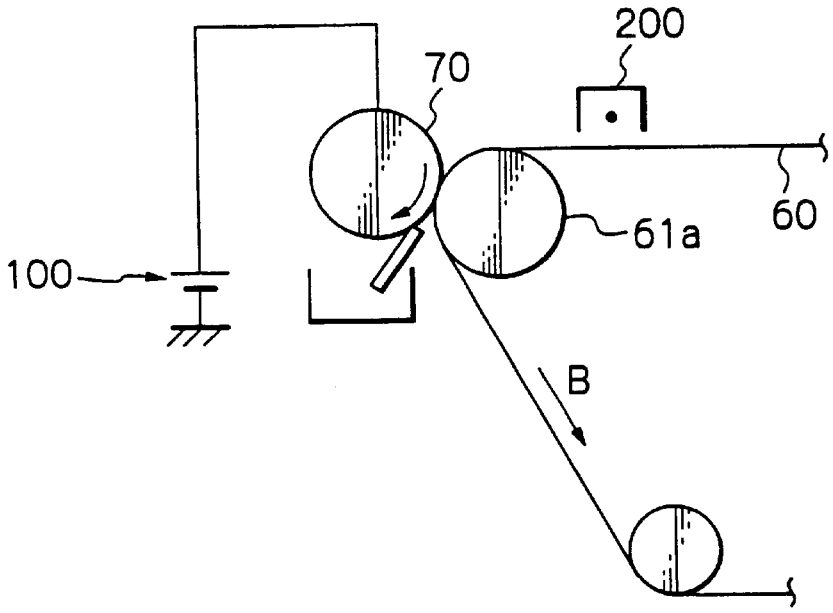
FIG. 6 is a fragmentary view showing a fourth modification.

FIG. 6 shows a fourth modification relating to the second embodiment and also forming an electric field that causes the toner of the developing liquid to efficiently move toward the cleaning roller 70. As shown, the fourth modification includes a corona charger 200, which is the most popular charge applying means, in addition to the arrangements shown in FIG. 5. Briefly, before the residual developing liquid on the belt 60 reaches the cleaning roller 70, the corona charger 200 applies to the toner of the liquid a charge whose polarity causes the toner to move toward the cleaning roller 70.

Specifically, the corona charger 20 applies a positive charge, which is opposite in polarity to the bias voltage applied to the cleaning roller 70, to the residual developing liquid on the belt 60 by discharge, thereby charging the toner of the liquid positive polarity. At this instant, the corona charger 200 forcibly charges the entire toner, including particles lost the charge and particles inverted in polarity ascribable to image transfer, to positive polarity. This promotes the movement of the toner from the belt 60 toward the cleaning roller 70 to be effected by the electric field formed between the belt 60 and the roller 70. Consequently, even the above particles can efficiently move from the belt 60 to the cleaning roller 70, so that the cleaning ability available with the electric field is improved.

The corona charger 200 is capable of forcibly charging the toner of the residual developing liquid to preselected polarity. Therefore, the above-described advantage is achievable even when the toner is charged to negative polarity while a positive bias voltage is applied to the cleaning roller 70. However, charging the toner to the same polarity as the chargeability of the toner promotes the effective use of limited resources because the residual toner moved to the cleaning roller 70 can be collected and reused.

Fifth Modification

Figure 7:
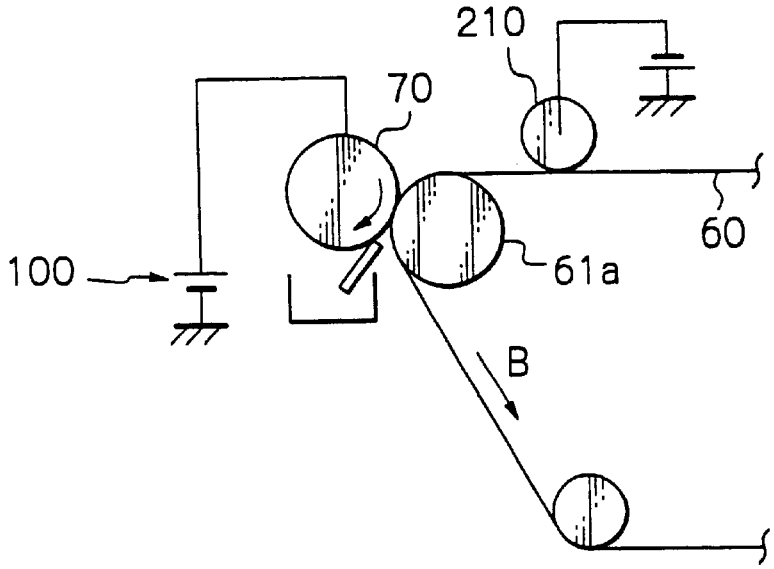
FIG. 7 is a fragmentary view showing a fifth modification.

FIG. 7 shows a fifth modification also relating to the second embodiment and using a conductive roller 210 as the charge applying means in place of the corona charger 200. The conductive roller or contact type charging member 210 is operable with a lower voltage than the corona charger 200 and therefore desirable from the safety standpoint. At the same time, the conductive roller 210 needs a minimum of current and contributes to energy saving. In addition, the conductive roller 210 produces less ozone, which is harmful, than the corona charger 200. The conductive roller 210 may be replaced with a brush, blade or similar contact type charging member, if desired.

Third Embodiment

Another alternative embodiment of the present invention, which is the combination of the first and second embodiments, will be described with reference to FIG. 8. Briefly, in the illustrative embodiment, the cleaning liquid 120 is fed to the cleaning roller 70 while the previously stated electric field is formed between the belt 60 and the cleaning roller 70.

Figure 8:
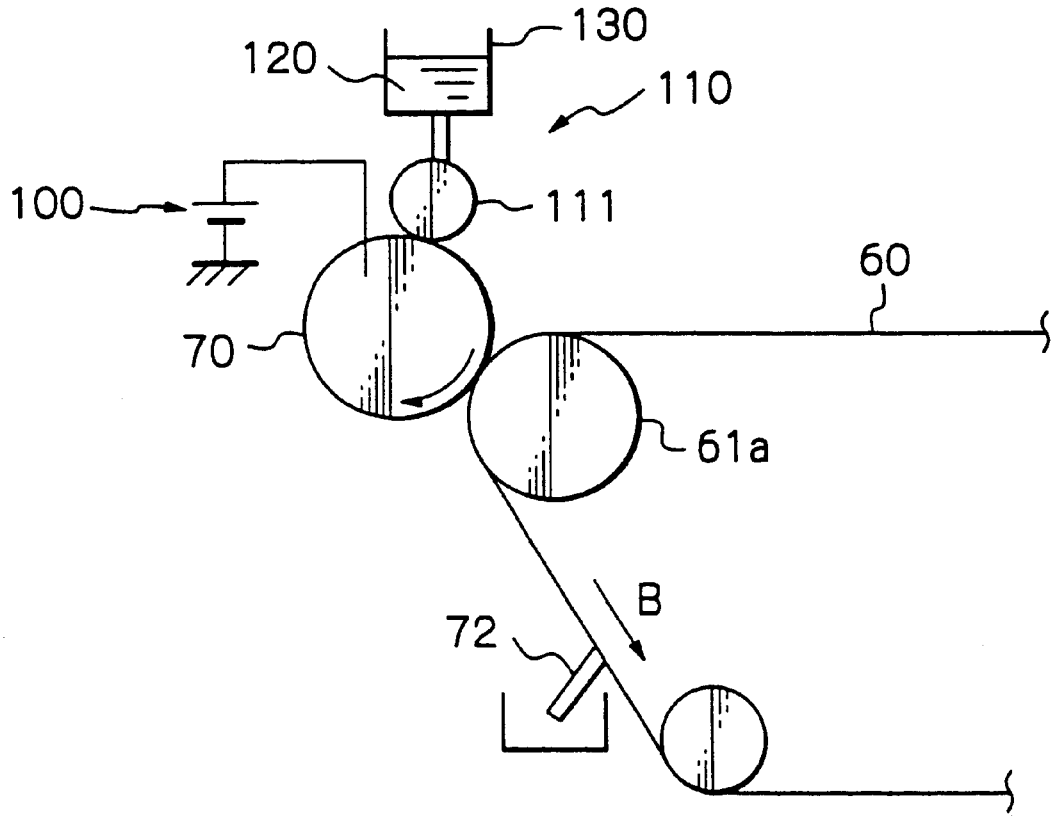
FIG. 8 is a fragmentary view showing a third embodiment of the present invention.

Specifically, as shown in FIG. 8, the copier includes the conductive cleaning roller or electric field forming means 70, bias power source 100 for applying a voltage to the roller 70, and liquid feeding device 110 for feeding the liquid 120 to the roller 70. In operation, the cleaning liquid 120 is fed to the belt 60 via the cleaning roller 70. The bias power source 100 applies to the cleaning roller 70 a voltage that may be opposite in polarity to the toner existing in the residual developing liquid. Consequently, the electric field acts on the toner, which is easy to clean because of the cleaning liquid 120, and thereby improves the cleaning ability.

Any one of the first to fifth modifications is similarly applicable to the third embodiment.

Fourth Embodiment

Figure 9:
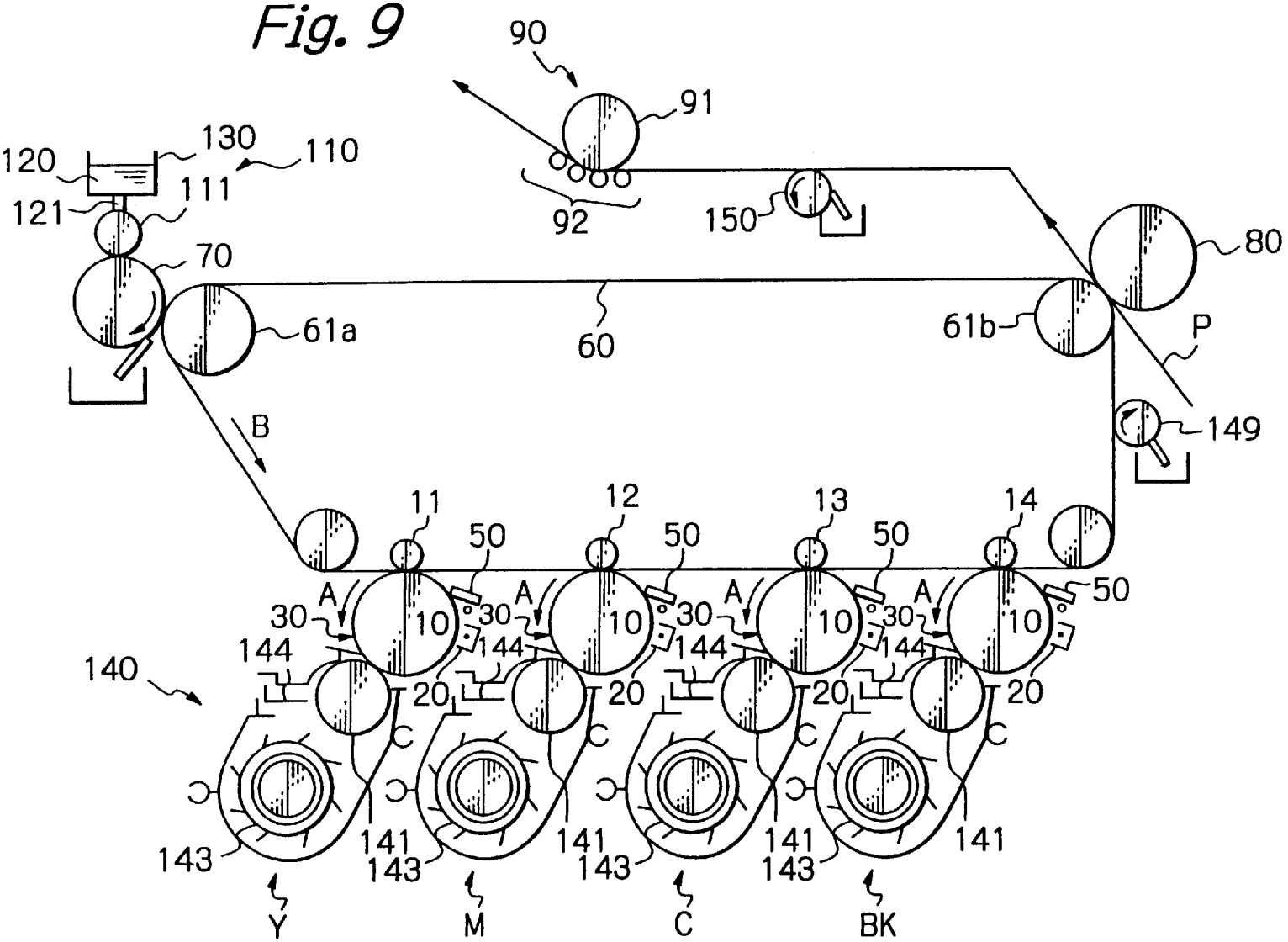
FIG. 9 is a view showing a fourth embodiment of the present invention.

Reference will be made to FIG. 9 for describing a further alternative embodiment of the present invention. This embodiment is implemented as a copier using a dry powdery developer containing at least toner therein. The basic construction of the illustrative embodiment is identical with the construction shown in FIG. 1 and will not be described specifically in order to avoid redundancy. As shown, the copier includes developing devices 140 each storing a developer of particular color and identical in configuration with each other. In the illustrative embodiment, use is made of a two-ingredient type developer, i.e. a toner and magnetic carrier mixture.

Each developing device 140 includes a developing sleeve or image carrier 141 for conveying the developer to a position where the sleeve 141 faces the drum 10. A paddle 143 agitates the developer. The developing sleeve 141 accommodates a magnet roller or magnetic field generating means therein. The paddle 141 conveys the developer from the front to the rear in the direction perpendicular to the sheet surface of FIG. 9 with a screw disposed therein. Also, the paddle 141 conveys the developer from the rear to the front in the above direction with a spiral provided on the outer periphery thereof. thereby circulating the developer. The paddle 143 agitates toner fed from a toner replenishing section, not shown, positioned outside of the developing device 140 together with the carrier. As a result, the toner and carrier are charged to negative polarity and positive polarity, respectively.

The agitated developer deposits on the developing sleeve 41 due to the magnetic force of the magnet roller. A doctor blade 141 is positioned upstream of the position where the developing sleeve 41 faces the drum 10 in the direction of developer conveyance. The doctor blade 141 levels the developer deposited on the developing sleeve 141 for thereby forming a uniform developer layer on the sleeve 141. The developing sleeve 141 conveys the uniform developer layer to the position where the sleeve 141 faces the drum 10.

The illustrative embodiment also includes the liquid feeding device 110 for feeding the cleaning liquid 120 to the cleaning roller 70. The cleaning liquid 120 removes the residual developer from the belt 60 in such a manner as to wash it away. Even when toner particles have a small particle size or a spherical shape and is therefore low in the probability of contact thereof with the cleaning roller 70, the cleaning Liquid 120 wets such particles in order to weaken their adhesion to the belt 60. This facilitates the removal of the toner by the cleaning roller 70 and thereby realizes an unprecedented cleaning ability. Further, when the cleaning member assigned to the belt 60 is implemented by a blade, there can be obviated the wear and damage of the blade itself as well as the influence on the drive of the belt 60, noise, and the deformation of the blade.

Any one of the first to fifth modifications is similarly applicable to the third embodiment also.

In the illustrative embodiment, too, the cleaning liquid 120 may be implemented by volatile silicone oil whose mean molecular weight is $10^3$ or below. However, the illustrative embodiment uses non-volatile silicone oil in order to achieve the following advantages. The cleaning liquid 120 deposited on the belt 60 is transferred to the drum 10 contacting the belt 60. The transfer of the cleaning liquid 120 to the drum 10 occurs even when the liquid film formed on the belt 60 is 1 $\mu$m thick or less. As a result, impurities including products derived from the charging operation deposit on the cleaning liquid 120 covering the drum 10, but deposit on the drum 10 little. It is therefore possible to reduce the frequency of polishing of the surface of the drum 10 or to make it practically needless.

Further, the cleaning liquid 120 is transferred to the paper sheet P contacting the belt 60 also. In addition, the cleaning liquid 120 is transferred to the heat roller 91 contacting the paper sheet P. This protects the offset of the paper sheet P to the heat roller 91 and thereby obviates the need for a parting agent otherwise applied to the heat roller 91 or reduces the necessary amount of the parting agent.

If desired, the cleaning liquid 120 may be fed to the cleaning blade 50 assigned to the drum 10 in the same manner. Also, an electric field may be formed between the drum 10 and the cleaning blade 50. The cleaning liquid 120 and electric field cooperate to remove the toner left on the drum 10 after the image transfer.

In anyone of the illustrative embodiments shown and described, the belt 60 playing the role of an intermediate image transfer body may be replaced with a roller, if desired.

In summary, it will be seen that the present invention provides an image forming apparatus having various unprecedented advantages, as enumerated below.

(1) The apparatus achieves a higher cleaning ability than conventional apparatuses. When a cleaning member is in implemented by, e.g. a blade, it does not effect the drive of an image carrier or bring about noise or the deformation of the blade. This is successful to reduce the wear and damage of the blade itself. When the apparatus operates with a dry powdery developer, a cleaning liquid fed to the surface of the image carrier prevents impurities from depositing on the image carrier and obviates offset during fixation.

(2) The apparatus is capable of using a recycled carrier liquid and therefore reduces the supply cost of the cleaning liquid.

(3) The apparatus prevents the cleaning liquid to deposit on the image carrier in an excessive amount and thereby obviates defective images. e.g., the flow of an image or disturbance ascribable to the liquid.

(4) The apparatus does not need means for removing or regulating the cleaning liquid or needs only means whose removing ability is low. This successfully reduces the cost and space requirements.

(5) Silicone oil used as the cleaning liquid obviates offset during fixation and therefore obviates the need for a parting agent otherwise fed to a fixing member or reduces the necessary amount of the parting agent. Further, silicone oil promotes the adhesion of the toner to the image-carrier and thereby further enhances the cleaning ability.

(6) By increasing the rotation speed of a rotary body, it is possible to intensify a shearing force to act on the toner deposited on the image carrier and therefore to improve the cleaning ability.

(7) An electric field for causing the toner, which is made easy to remove by the cleaning liquid, to move toward the cleaning member acts on the toner, further improving the cleaning ability.

(8) The above electric field causes even toner particles lost a charge or inverted in polarity due to image transfer to move toward the cleaning member.

(9) The toner removed by the cleaning member can be collected and reused.

(10) A corona charger, which is the most popular charge applying means, is used and can be readily built in the apparatus.

(11) A contact type charging member, as distinguished from the corona charger or non-contact type charging member, enhances safety and contributes to energy saving while reducing harmful ozone.

Various modifications will become possible for those skilled in the art after receiving the teachings of the present disclosure without departing from the scope thereof.

What is claimed is:

1. An image forming apparatus comprising:

developing means using a developing liquid including a carrier liquid and toner dispersed in said carrier liquid;

a first image carrier means for carrying a toner image developed by said developing means;

an intermediate image carrier means mounted in an image transfer position relative to the first image carrier means for receiving and carrying the toner image transferred thereto from the first image carrier means;

a recording medium means mounted in an image transfer position relative to the intermediate image carrier means for receiving the toner image transferred from the intermediate image carrier means;

cleaning means for cleaning a surface of said intermediate image carrier means after the toner image has been transferred from said intermediate image carrier means to the recording medium means;

liquid feeding means for feeding a cleaning liquid to said cleaning means; and an electric field means for forming an electric field between the intermediate image carrier means and the cleaning means that causes the toner of a residual developing liquid remaining on the intermediate image carrier after the toner image has been transferred to the recording medium means to move toward the cleaning means.

2. An apparatus as claimed in claim 1, wherein the cleaning liquid is identical with a component of the carrier liquid.

3. An apparatus as claimed in claim 2, further comprising at least one of removing means for removing the cleaning liquid from the surface of said intermediate image carrier means and regulating means for regulating an amount of the cleaning liquid.

4. An apparatus as claimed in claim 3, wherein the cleaning liquid is volatile.

5. An apparatus as claimed in claim 4, wherein the cleaning liquid comprises silicone oil.

6. An apparatus as claimed in claim 5, wherein said cleaning means comprises a rotary body.

7. An apparatus as claimed in claim 1, further comprising charge applying means for applying a charge of a preselected polarity to the toner of the residual developing liquid before the residual developing liquid reaches said cleaning means, said preselected polarity being a polarity that will aid the movement of the toner of the residual developing liquid toward said cleaning means via the electric field.

8. An apparatus as claimed in claim 7, wherein said charge applying means comprises a corona charger.

9. An apparatus as claimed in claim 7, wherein said charge applying means comprises a contact type charging member.

10. An apparatus as claimed in claim 1, further comprising at least one of removing means for removing the cleaning liquid from the surface of said intermediate image carrier means and regulating means for regulating an amount of the cleaning liquid.

11. An apparatus as claimed in claim 10, wherein the cleaning liquid is volatile.

12. An apparatus as claimed in claim 11, wherein the cleaning liquid comprises silicone oil.

13. An apparatus as claimed in claim 12, wherein said cleaning means comprises a rotary body.

14. An apparatus as claimed in claim 13, further comprising charge applying mean for applying a charge of a preselected polarity to the toner of the residual developing liquid before the residual developing liquid reaches said cleaning means, said preselected polarity being a polarity that will aid the movement of the toner of the residual developing liquid toward said cleaning means via the electric field.

15. An apparatus as claimed in claim 14, wherein said charge applying means comprises a corona charger.

16. An apparatus as claimed in claim 14, wherein said charge applying means comprises a contact type charging member.

17. An apparatus as claimed in claim 1, wherein the cleaning liquid is volatile.

18. An apparatus as claimed in claim 17, wherein the cleaning liquid comprises silicone oil.

19. An apparatus as claimed in claim 18, wherein said cleaning means comprises a rotary body.

20. An apparatus as claimed in claim 19, further comprising charge applying means for a charge of a preselected polarity to the toner of the residual developing liquid before the residual developing liquid reaches said cleaning means, said preselected polarity being a polarity that will aid the movement of the toner of the residual developing liquid toward said cleaning means via the electric field.

21. An apparatus as claimed in claim 20, wherein said charge applying means comprises a corona charger.

22. An apparatus as claimed in claim 20, wherein said charge applying means comprises a contact type charging member.

23. An apparatus as claimed in claim 1, wherein the cleaning liquid comprises silicone oil.

24. An apparatus as claimed in claim 23, wherein said cleaning means comprises a rotary body.

25. An apparatus as claimed in claim 24, further comprising charge applying means for applying a charge of a preselected polarity to the toner of the residual developing liquid before the residual developing liquid reaches said cleaning means, said preselected polarity being a polarity that will aid the movement of the toner of the residual developing liquid toward said cleaning means via the electric field.

26. An apparatus as claimed in claim 25, wherein said charge applying means comprises a corona charger.

27. An apparatus as claimed in claim 25, wherein said charge applying means comprises a contact type charging member.

28. An apparatus as claimed in claim 1, wherein said cleaning means comprises a rotary body.

29. An apparatus as claimed in claim 28, further comprising charge applying means for applying a charge of a preselected polarity to the toner of the residual developing liquid before the residual developing liquid reaches said cleaning means, said preselected polarity being a polarity that will aid the movement of the toner of the residual developing liquid toward said cleaning means via the electric field.

30. An apparatus as claimed in claim 29, wherein said charge applying means comprises a corona charger.

31. An apparatus as claimed in claim 29, wherein said charge applying means comprises a contact type charging member.

32. An image forming apparatus comprising:

a first image carrier means for carrying a toner image developed by said developing means;

an intermediate image carrier means mounted in an image transfer position relative to the first image carrier means for receiving and carrying the toner image transferred thereto from the intermediate image carrier means;

a recording medium means mounted in an image transfer position relative to the intermediate image carrier means for receiving the toner image transferred from the intermediate image carrier means;

cleaning means for cleaning a surface of said intermediate image carrier means after the toner image has been transferred from said intermediate image carrier means to the recording medium means;

liquid feeding means for feeding a cleaning liquid to said cleaning means; and charge applying means for applying a charge of a preselected polarity to the toner of residual developing liquid remaining on the intermediate image carrier means after the toner image has been transferred to the recording medium means; and electric field means for forming an electric field causing the toner charged by said charging means to the preselected charge to move toward said cleaning means.

33. An apparatus as claimed in claim 32, wherein the preselected polarity is identical with a polarity to which the toner used for development is charged.

34. An apparatus as claimed in claim 33, wherein said charge applying means comprises a corona charger.

35. An apparatus as claimed in claim 33, wherein said charge applying means comprises a contact type charging member.

36. An image forming apparatus comprising:

developing means using a developing liquid consisting of a carrier liquid and toner dispersed in said carrier liquid;

an image carrier for carrying a toner image developed by said developing means;

cleaning means for cleaning a surface of said image carrier after the toner image has been transferred from said image carrier to a recording medium; and liquid feeding means for feeding a cleaning liquid to a surface of said image carrier after said surface has moved away from an image transfer position, but before said surface reaches said cleaning means;

said image carrier comprising an intermediate image transfer body for carrying the toner image transferred thereto from another image carrier, wherein said toner image is transferred from said intermediate image transfer body to the recording medium.

37. An apparatus as claimed in claim 36, wherein the cleaning liquid is identical with a component of the carrier liquid.

38. An apparatus as claimed in claim 37, further comprising at least one of removing means for removing the cleaning liquid from the surface of said image carrier and regulating means for regulating an amount of the cleaning liquid.

39. An apparatus as claimed in claim 38, wherein the cleaning liquid is volatile.

40. An apparatus as claimed in claim 39, wherein the cleaning liquid comprises silicone oil.

41. An apparatus as claimed in claim 40, wherein said cleaning means comprises a rotary body.

42. An apparatus as claimed in claim 41, further comprising electric field forming means for forming an electric field, which causes the toner of a residual developing liquid remaining on said image carrier to move from said image carrier toward a surface of said cleaning means, between said image carrier and said cleaning member.

43. An apparatus as claimed in claim 42, further comprising charge applying means for applying, before the residual developing liquid reaches said cleaning means, a charge whose polarity causes the toner of the residual developing liquid to move toward the surface of said cleaning means via the electric field to said toner.

44. An apparatus as claimed in claim 43, wherein said charge applying means comprises a contact type charging member.

45. An apparatus as claimed in claim 36, further comprising at least one of removing means for removing the cleaning liquid from the surface of said image carrier and regulating means for regulating an amount of the cleaning liquid.

46. An apparatus as claimed in claim 45, wherein the cleaning liquid is volatile.

47. An apparatus as claimed in claim 46, wherein the cleaning liquid comprises silicone oil.

48. An apparatus as claimed in claim 47, wherein said cleaning means comprises a rotary body.

49. An apparatus as claimed in claim 48, further comprising electric field forming means for forming an electric field, which causes the toner of a residual developing liquid remaining on said image carrier to move from said image carrier toward a surface of said cleaning means, between said image carrier and said cleaning member.

50. An apparatus as claimed in claim 49, further comprising charge applying means for applying, before the residual developing liquid reaches said cleaning means, a charge whose polarity causes the toner of the residual developing liquid to move toward the surface of said cleaning means via the electric field to said toner.

51. An apparatus as claimed in claim 50, wherein said charge applying means comprises a contact type charging member.

52. An apparatus as claimed in claim 36, wherein the cleaning liquid is volatile.

53. An apparatus as claimed in claim 52, wherein the cleaning liquid comprises silicone coil.

54. An apparatus as claimed in claim 53, wherein said cleaning means comprises a rotary body.

55. An apparatus as claimed in claim 54, further comprising electric field forming means for forming an electric field, which causes the toner of a residual developing liquid remaining on said image carrier to move from said image carrier toward a surface of said cleaning means, between said image carrier and said cleaning member.

56. An apparatus as claimed in claim 55, further comprising charge applying means for applying, before the residual developing liquid reaches said cleaning means, a charge whose polarity causes the toner of the residual developing liquid to move toward the surface of said cleaning means via the electric field to said toner.

57. An apparatus as claimed in claim 56, wherein said charge applying means comprises a contact type charging member.

58. An apparatus as claimed in claim 36, wherein the cleaning liquid comprises silicone oil.

59. An apparatus as claimed in claim 58, wherein said cleaning means comprises a rotary body.

60. An apparatus as claimed in claim 59, further comprising electric field forming means for forming an electric field, which causes the toner of a residual developing liquid remaining on said image carrier to move from said image carrier toward a surface of said cleaning means, between said image carrier and said cleaning member.

61. An apparatus as claimed in claim 60, further comprising charge applying means for applying, before the residual developing liquid reaches said cleaning means, a charge whose polarity causes the toner of the residual developing liquid to move toward the surface of said cleaning means via the electric field to said toner.

62. An apparatus as claimed in claim 61, wherein said charge applying means comprises a contact type charging member.

63. An apparatus as claimed in claim 36, wherein said cleaning means comprises a rotary body.

64. An apparatus as claimed in claim 63, further comprising electric field forming means for forming an electric field, which causes the toner of a residual developing liquid remaining on said image carrier to move from said image carrier toward a surface of said cleaning means, between said image carrier and said cleaning member.

65. An apparatus as claimed in claim 64, further comprising charge applying means for applying, before the residual developing liquid reaches said cleaning means, a charge whose polarity causes the toner of the residual developing liquid to move toward the surface of said cleaning means via the electric field to said toner.

66. An apparatus as claimed in claim 65, wherein said charge applying means comprises a contact type charging member.

67. An apparatus as claimed in claim 36, further comprising electric field forming means for forming an electric field, which causes the toner of a residual developing liquid remaining on said image carrier, to move from said image carrier toward a surface of said cleaning means, between said image carrier and said cleaning member.

68. An apparatus as claimed in claim 67, further comprising charge applying means for applying, before the residual developing liquid reaches said cleaning means, a charge whose polarity causes the toner of the residual developing liquid to move toward the surface of said cleaning means via the electric field to said toner.

69. An apparatus as claimed in claim 68, wherein said charge applying means comprises a contact type charging member.

70. An apparatus as claimed in claim 36, further comprising:

charge applying means for applying, before a residual developing liquid remaining on said image carrier reaches said cleaning means, a charge of a preselected polarity to the toner of the residual developing liquid; and electric field forming means for causing the toner charged by said charge applying means to move toward a surface of said cleaning member.

71. An apparatus as claimed in claim 70, wherein the preselected polarity is identical with a polarity to which the toner used for development is charged.

72. An apparatus as claimed in claim 71, wherein said charge applying means comprises a corona charger.

73. An apparatus as claimed in claim 71, wherein said charge applying means comprises a contact type charging member.

74. An image forming apparatus comprising:

developing means using a powdery developer containing at least toner;

an image carrier means for carrying a toner image developed by said developing means;

a recording medium means mounted in an image transfer position relative to the image carrier means for receiving the toner image transferred from the image carrier means;

cleaning means for cleaning a surface of said image carrier means after the toner image has been transferred from said image carrier means to the recording medium means;

liquid feeding means for feeding a cleaning liquid to said cleaning means; and an electric field means for forming an electric field between the image carrier means and the cleaning means that causes the toner of a residual developer remaining on the image carrier means after the toner image has been transferred to the recording medium means to move toward the cleaning means.

75. An apparatus as claimed in claim 74, further comprising at least one of removing means for removing the cleaning liquid from the surface of said image carrier means and regulating means for regulating an amount of the cleaning liquid.

76. An apparatus as claimed in claim 75, wherein the cleaning liquid is volatile.

77. An apparatus as claimed in claim 76, wherein the cleaning liquid comprises silicone oil.

78. An apparatus as claimed in claim 77, wherein said cleaning means comprises a rotary body.

79. An apparatus as claimed in claim 78, further comprising charge applying means for applying a charge of a preselected polarity to the toner of the residual developer before the residual developer reaches said cleaning means, said preselected polarity being a polarity that will aid the movement of the toner of the residual developer toward said cleaning means via the electric field.

80. An apparatus as claimed in claim 79, wherein said charge applying means comprises a contact type charging member.

81. An apparatus as claimed in claim 74, wherein the cleaning liquid is volatile.

82. An apparatus as claimed in claim 74, wherein the cleaning liquid comprises silicone oil.

83. An apparatus as claimed in claim 82, wherein said cleaning means comprises a rotary body.

84. An apparatus as claimed in claim 83, further comprising charge applying means for applying a charge of a preselected polarity to the toner of the residual developer before the residual developer reaches said cleaning means, said preselected polarity being a polarity that will aid the movement of the toner of the residual developer toward said cleaning means via the electric field.

85. An apparatus as claimed in claim 84, wherein said charge applying means comprises a contact type charging member.

86. An apparatus as claimed in claim 74, wherein the cleaning liquid comprises silicone oil.

87. An apparatus as claimed in claim 86, wherein said cleaning means comprises a rotary body.

88. An apparatus as claimed in claim 87, further comprising charge applying means for applying a charge of a preselected polarity to the toner of the residual developer before the residual developer reaches said cleaning means, said preselected polarity being a polarity that will aid the movement of the toner of the residual developer toward said cleaning means via the electric field.

89. An apparatus as claimed in claim 88, wherein said charge applying means comprises a contact type charging member.

90. An apparatus as claimed in claim 74, wherein said cleaning means comprises a rotary body.

91. An apparatus as claimed in claim 90, further comprising charge applying means for applying a charge of a preselected polarity to the toner of the residual developer before the residual developer reaches said cleaning means, said preselected polarity being a polarity that will aid the movement of the toner of the residual developer toward said cleaning means via the electric field.

92. An apparatus as claimed in claim 91, wherein said charge applying means comprises a contact type charging member.

93. An apparatus as claimed in claim 74, further comprising charge applying means for applying a charge of a preselected polarity to the toner of the residual developer before the residual developer reaches said cleaning means, said preselected polarity being a polarity that will aid the movement of the toner of the residual developer toward said cleaning means via the electric field.

94. An apparatus as claimed in claim 93, wherein said charge applying means comprises a contact type charging member.

95. An image forming apparatus comprising:

developing means using a powdery developer containing at least toner;

an image carrier means for carrying a toner image developed by said developing means;

a recording medium means mounted in an image transfer position relative to the image carrier means for receiving the toner image transferred from the image carrier means;

cleaning means for cleaning a surface of said image carrier means after the toner image has been transferred from the image carrier means to the recording medium means;

liquid feeding means for feeding a cleaning liquid to said cleaning means; and charge applying means for applying a charge of a preselected polarity to the toner of residual developer remaining on the image carrier means after the toner image has been transferred to the recording medium means.

96. An apparatus as claimed in claim 95, wherein said charge applying means comprises a contact type charging member.

97. An image forming apparatus comprising:

developing means using a powdery developer containing at least toner;

an image carrier means for carrying a toner image developed by said developing means;

a recording medium means mounted in an image transfer position relative to the image carrier means for receiving the toner image transferred from the image carrier means;

cleaning means for cleaning a surface of said image carrier means after the toner image has been transferred from the image carrier means to the recording medium means;

liquid feeding means for feeding a cleaning liquid to said cleaning means;

charge applying means for applying a charge of a preselected polarity to the toner of residual developer remaining on the image carrier means after the toner image has been transferred to the recording medium means; and electric field means for forming an electric field causing the toner charged by said charging means to the preselected charge to move away from the surface of said image carrier means.

98. An apparatus as claimed in claim 97, wherein the preselected polarity is identical with a polarity to which the toner used for development is charged.

99. An apparatus as claimed in claim 98, wherein said charge applying means comprises a corona charger.

100. An apparatus as claimed in claim 98, wherein said charge applying means comprises a contact type charging member.

101. An image forming apparatus comprising:

developing means using a powdery developer containing at least toner;

an image carrier for carrying a toner image developed by said developing means;

cleaning means for cleaning a surface of said image carrier after the toner image has been transferred from said image carrier to a recording medium; and liquid feeding means for feeding a cleaning liquid to a surface of said image carrier after said surface has moved away from an image transfer position, but before said surface reaches said cleaning means.

102. An apparatus as claimed in claim 101, further comprising at least one of removing means for removing the cleaning liquid from the surface of said image carrier and regulating means for regulating an amount of the cleaning liquid.

103. An apparatus as claimed in claim 102, wherein the cleaning liquid is volatile.

104. An apparatus as claimed in claim 103, wherein the cleaning liquid comprises silicone oil.

105. An apparatus as claimed in claim 104, wherein said cleaning means comprises a rotary body.

106. An apparatus as claimed in claim 105, further comprising electric field forming means for forming an electric field, which causes the toner of a residual developer remaining on said image carrier to move from said image carrier toward a surface of said cleaning means, between said image carrier and said cleaning member.

107. An apparatus as claimed in claim 101, wherein the cleaning liquid is volatile.

108. An apparatus as claimed in claim 107, wherein the cleaning liquid comprises silicone oil.

109. An apparatus as claimed in claim 108, wherein said cleaning means comprises a rotary body.

110. An apparatus as claimed in claim 109, further comprising electric field forming means for forming an electric field, which causes the toner of a residual developer remaining on said image carrier to move from said image carrier toward a surface of said cleaning means, between said image carrier and said cleaning member.

111. An apparatus as claimed in claim 101, wherein the cleaning liquid comprises silicone oil.

112. An apparatus as claimed in claim 111, wherein said cleaning means comprises a rotary body.

113. An apparatus as claimed in claim 112, further comprising electric field forming means for forming an electric field, which causes the toner of a residual developer remaining on said image carrier to move from said image carrier toward a surface of said cleaning means, between said image carrier and said cleaning member.

114. An apparatus as claimed in claim 101, wherein said cleaning means comprises a rotary body.

115. An apparatus as claimed in claim 114, further comprising electric field forming means for forming an electric field, which causes the toner of a residual developer remaining on said image carrier to move from said image carrier toward a surface of said cleaning means, between said image carrier and said cleaning member.

116. An apparatus as claimed in claim 101, further arising electric field forming means for forming an electric field, which causes the toner of a residual developer remaining on said image carrier to move from said image carrier toward a surface of said cleaning means, between said image carrier and said cleaning member.

117. An apparatus as claimed in claim 101, further comprising charge applying means for applying, before the residual developer reaches said cleaning means, a charge whose polarity causes the toner of the residual developer to move toward the surface of said cleaning means via the electric field to said toner.

118. An apparatus as claimed in claim 117, wherein said charge applying means comprises a contact type charging member.

119. An apparatus as claimed in claim 101, further comprising:

charge applying means for applying, before a residual developing liquid remaining on said image carrier reaches said cleaning means, a charge of a preselected polarity to the toner of the residual developing liquid: and electric field forming means for causing the toner charged by said charge applying means to move toward a surface of said cleaning member.

120. An apparatus as claimed in claim 119, wherein the preselected polarity is identical with a polarity to which the toner used for development is charged.

121. An apparatus as claimed in claim 120, wherein said charge applying means comprises a corona charger.

122. An apparatus as claimed in claim 120, wherein said charge applying means comprises a contact type charging member.

123. An image forming apparatus comprising:

developing means using a developing liquid consisting of a carrier liquid and toner dispersed in said carrier liquid;

an image carrier for carrying a toner image developed by said developing means;

cleaning means for cleaning a surface of said image carrier after the toner image has been transferred from said image carrier to a recording medium; and electric field forming means for forming an electric field, which causes the toner of a residual developing liquid remaining on said image carrier to move toward a surface of said cleaning means, between said image carrier and said cleaning means.

124. An apparatus as claimed in claim 123, further comprising charge applying means for applying, before the residual developing liquid reaches said cleaning means, a charge whose polarity causes the toner of the residual developing liquid to move toward the surface of said cleaning means via the electric field to said toner.

125. An apparatus as claimed in claim 124, wherein said charge applying means comprises a corona charger.

126. An apparatus as claimed in claim 124, wherein said charge applying means comprises a contact type charging member.

127. An image forming apparatus comprising:

a developing device configured to use a developing liquid including a carrier liquid and toner dispersed in said carrier liquid;

an image carrier configured to carry a toner image developed by said developing device;

an intermediate image transfer body mounted in an image transfer position relative to the image carrier and configured to receive and carry the toner image transferred thereto from the first image carrier;

a recording medium mounted in an image transfer position relative to the intermediate image transfer body and configured to receive the toner image transferred from the intermediate image transfer body;

a cleaning member configured to clean a surface of said intermediate image transfer body after the toner image has been transferred from said intermediate image transfer body to a recording medium;

a liquid feeding device constructed to feed a cleaning liquid to said cleaning member; and an electric field generator configured to generate an electric field between the intermediate image transfer body and the cleaning member to cause the toner of a residual developing liquid remaining on the intermediate image transfer body after the toner image has been transferred to the recording medium to move toward said cleaning member.

128. An image forming apparatus comprising:

a developing device using a developing liquid consisting of a carrier liquid and toner dispersed in said carrier liquid;

an image carrier configured to carry a toner image developed by said developing device;

a cleaning member configured to clean a surface of said image carrier after the toner image has been transferred from said image carrier to a recording medium; and a liquid feeding device for feeding a cleaning liquid to a surface of said image carrier after said surface has moved away from an image transfer position, but before said surface reaches said cleaning member;

said image carrier comprising an intermediate image transfer body for carrying the toner image transferred thereto from another image carrier, wherein said toner image is transferred from said intermediate image transfer body to the recording medium.

129. An image forming apparatus comprising:

a developing device configured to use a powdery developer containing at least toner;

an image carrier configured to carry a toner image developed by said developing device;

a recording medium mounted in an image transfer position relative to the image carrier and configured to receive the toner image transferred from the image carrier;

a cleaning member configured to clean a surface of said image carrier after the toner image has been transferred from said image carrier to the recording medium;

a liquid feeding device configured to feed a cleaning liquid to said cleaning member; and an electric field generator configured to generate an electric field between the image carrier and the cleaning member to cause the toner of a residual developer remaining on the image carrier after the toner image has been transferred to the recording medium to move toward said cleaning member.

130. An image forming apparatus comprising:

a developing device using a powdery developer containing at least toner;

an image carrier configured to carry a toner image developed by said developing device;

a cleaning member for cleaning a surface of said image carrier after the toner image has been transferred from said image carrier to a recording medium; and a liquid feeding device for feeding a cleaning liquid to a surface of said image carrier after said surface has moved away from an image transfer position, but before said surface reaches said cleaning means.

131. An image forming apparatus comprising:

a developing device using a developing liquid consisting of a carrier liquid and toner dispersed in said carrier liquid;

an image carrier configured to carry a toner image developed by said developing device;

a cleaning member configured to clean a surface of said image carrier after the toner image has been transferred from said image carrier to a recording medium; and an electric field forming device configured to form an electric field, which causes the toner of a residual developing liquid remaining on said image carrier to move toward a surface of said cleaning member, between said image carrier and said cleaning member.

* * * * *